US007322502B1

(12) United States Patent
Sun

(10) Patent No.: US 7,322,502 B1
(45) Date of Patent: Jan. 29, 2008

(54) PROTECTION DEVICE FOR DC-POWERED NAIL GUN

(76) Inventor: Pei-Chang Sun, 5F-2, No. 181, Sec. 2, Mei-Tsun Rd., Taichung City (TW)

( * ) Notice: Subject to any disclaimer, the term of this patent is extended or adjusted under 35 U.S.C. 154(b) by 0 days.

(21) Appl. No.: 11/492,024

(22) Filed: Jul. 25, 2006

(51) Int. Cl.
*B25C 5/00* (2006.01)

(52) U.S. Cl. ..... 227/8; 227/131; 227/132

(58) Field of Classification Search ..... 227/8, 227/131, 132, 120, 129; 173/117, 217
See application file for complete search history.

(56) References Cited

U.S. PATENT DOCUMENTS 4,033,500 A * 7/1977 Manganaro ..... 227/131
4,108,345 A * 8/1978 Manganaro ..... 227/131
4,449,660 A * 5/1984 Smith, III ..... 227/8
4,724,992 A * 2/1988 Ohmori ..... 227/146
4,953,774 A * 9/1990 Lai ..... 227/131
5,118,023 A * 6/1992 Fushiya et al. ..... 227/8
5,605,268 A * 2/1997 Hayashi et al. ..... 227/8
5,720,423 A * 2/1998 Kondo et al. ..... 227/130
5,927,585 A * 7/1999 Moorman et al. ..... 227/132
6,672,498 B2 * 1/2004 White et al. ..... 222/120
6,997,367 B2 * 2/2006 Hu ..... 227/132
7,121,443 B2 * 10/2006 Sun et al. ..... 227/131
7,152,774 B2 * 12/2006 Chen ..... 227/131

* cited by examiner

*Primary Examiner*—Scott A. Smith

(57) ABSTRACT

A protection device of a DC-powered nail gun includes collar mounted to a connection rod on the trigger and the collar has an inner diameter larger than an outer periphery of the connection rod so that when the trigger is not pulled, the collar is positioned to pivot a second switch so that the push member of the shooting unit of the nail gun cannot activate an activation button on the second switch when a new battery pack is installed. By the collar and the pivoted second switch, the nail cannot shoot even if the push member is powered and moved by the new battery pack.

2 Claims, 5 Drawing Sheets

PROTECTION DEVICE FOR DC-POWERED NAIL GUN

FIELD OF THE INVENTION

The present invention relates to a protection device for avoid from unintentionally shooting when a new battery pack is installed.

BACKGROUND OF THE INVENTION

A conventional electrical nail gun is powered by AC power which requires a cord connected between the nail gun and a receptacle or a power supply unit. However, the cord might be tangled by object and pulls the nail gun off from the user's hand. This could lead to a dangerous result. Therefore, a DC-powered nail gun resolves all the shortcomings of the conventional electric nail gun and only a battery pack is needed which is usually connected to an underside of the handle of the nail gun. The battery pack provides necessary electric power to the nail gun so that the nail gun can be freely moved without being tangled. The power of the battery pack drives a disk which has a protrusion and a push rod is then moved backward and a spring mounted on the push rod is compressed so as to generate the needed force to shoot the nails. In a specific condition, when the disk is rotated an angle and the spring is compressed, the battery pack runs out while the push rod is still in that position where the force is stored by the spring. The user then replaces a new battery pack to the nail gun. The new battery pack provides sufficient electric power and the disk then rotates from the position when the previous battery pack runs out. This might cause a sudden shoot when the nail gun is not aimed toward the object to he nailed.

The present invention intends to provide a protection device that shift a switch away from the protrusion of the disk when replacing a new battery pack so that no sudden shoot may happen.

SUMMARY OF THE INVENTION

The present invention relates to a DC-powered nail gun that includes a body having a barrel and a handle is connected to the barrel. A nose is connected to a front end of the barrel and a magazine is connected to the nose so that nails can be ejected from the nose. A shooting unit is received in the barrel and has a frame along which a push member is movably mounted. A rod is connected to the frame and a first spring is mounted to the rod so that the push member can be pushed to compress the first spring and ejects a nail by the first spring. An end cap is connected to a rear end of the barrel.

A driving unit includes a driving mechanism which is electrically connected to a battery pack and the driving mechanism includes a disk which has a protrusion extending from a top thereof so as to move the push member to compress the first spring.

A trigger is connected to the handle and a slide member is connected to the trigger. A first switch is connected to the slide member and a swing bar rotatably extends through the slide member.

A protection device is received in the shooting unit and has a switch frame located on a top of the trigger. A connection rod extends from the trigger and extends through the switch frame. A collar is mounted to an outer periphery of the connection rod and an inner diameter of the collar is larger than an outer diameter of the connection rod so that the collar is movably supported by the switch frame. A positioning rod extends from the switch frame and pivotably connected to a first corner of a second switch. A second spring biases a second corner of the second switch, wherein the first and second corners are located on two opposite sides of the second switch so that the second switch is pivoted about the positioning rod by the second spring. A base is located beside the second switch and has a push rod connected thereto. A third spring is mounted on the push rod so that the push rod and the base are pushed by the swing bar to shot off the first switch. The switch frame has a guide rod which includes an inclined surface which pushes the collar to pivot the second switch so that an activation button on the second switch is moved away from the push member when the trigger is not pulled.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
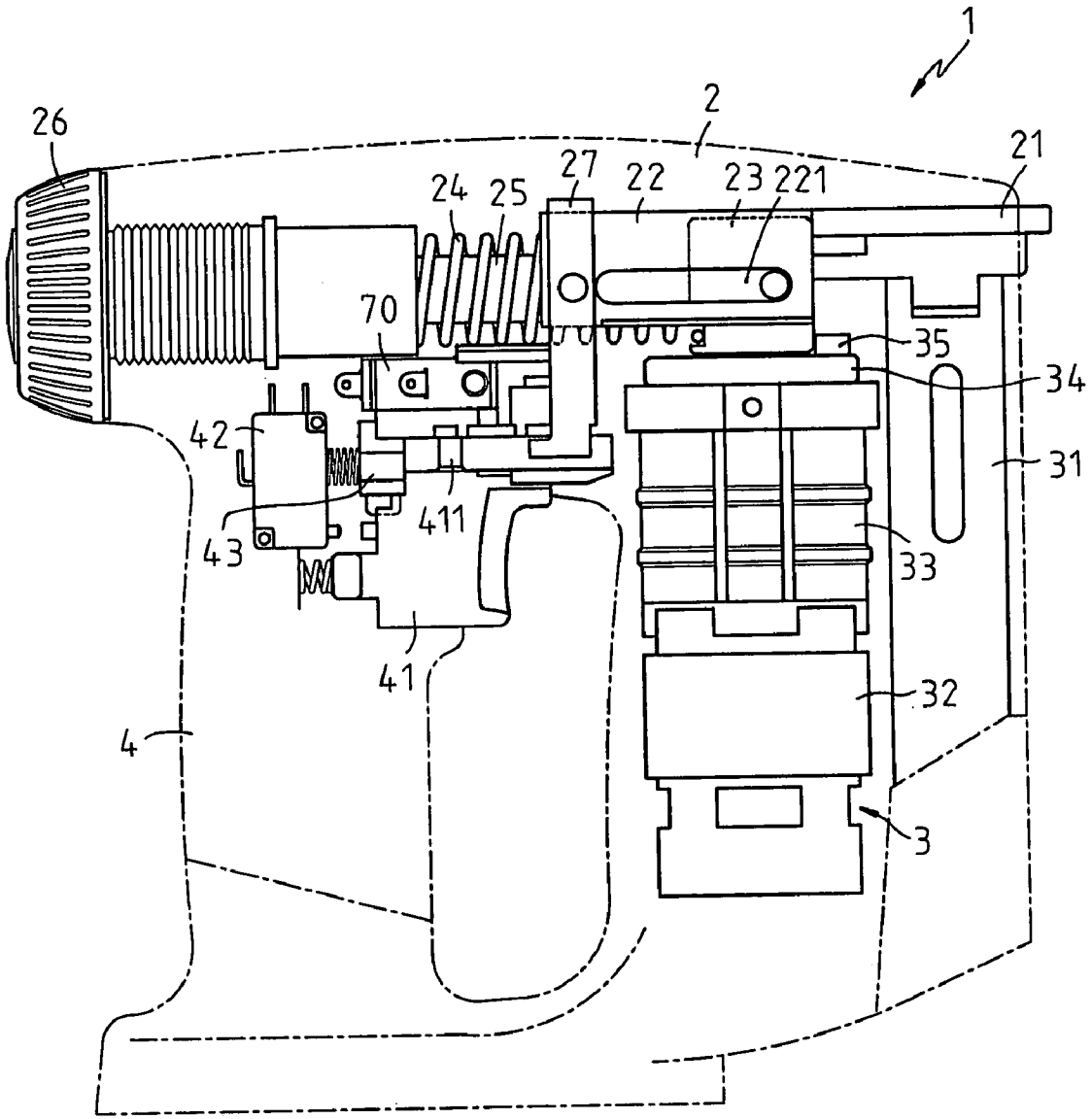
FIG. 1 is side view of the nail gun of the present invention.
Figure 2:
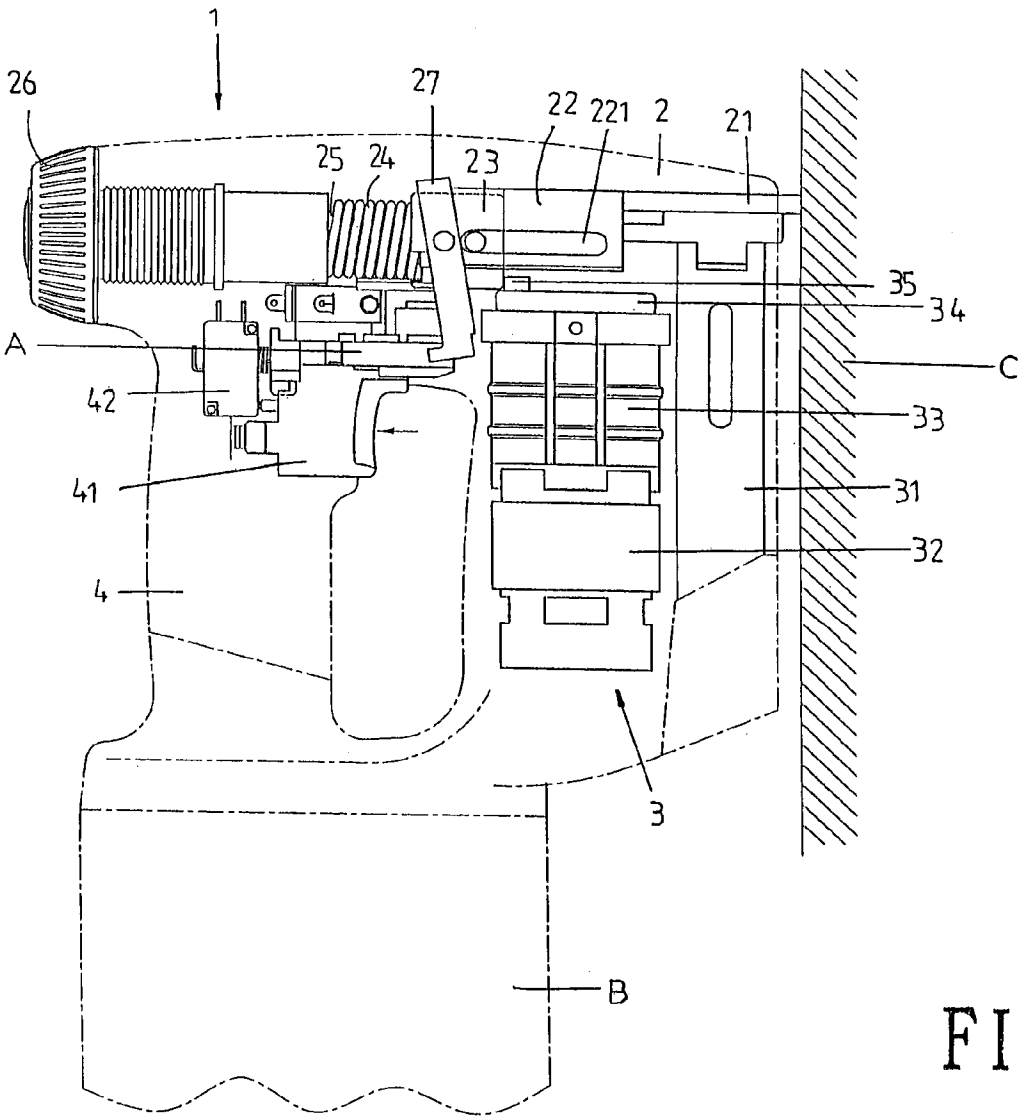
FIG. 2 is a side view to show that the nose is pushed against an object.
Figure 3:
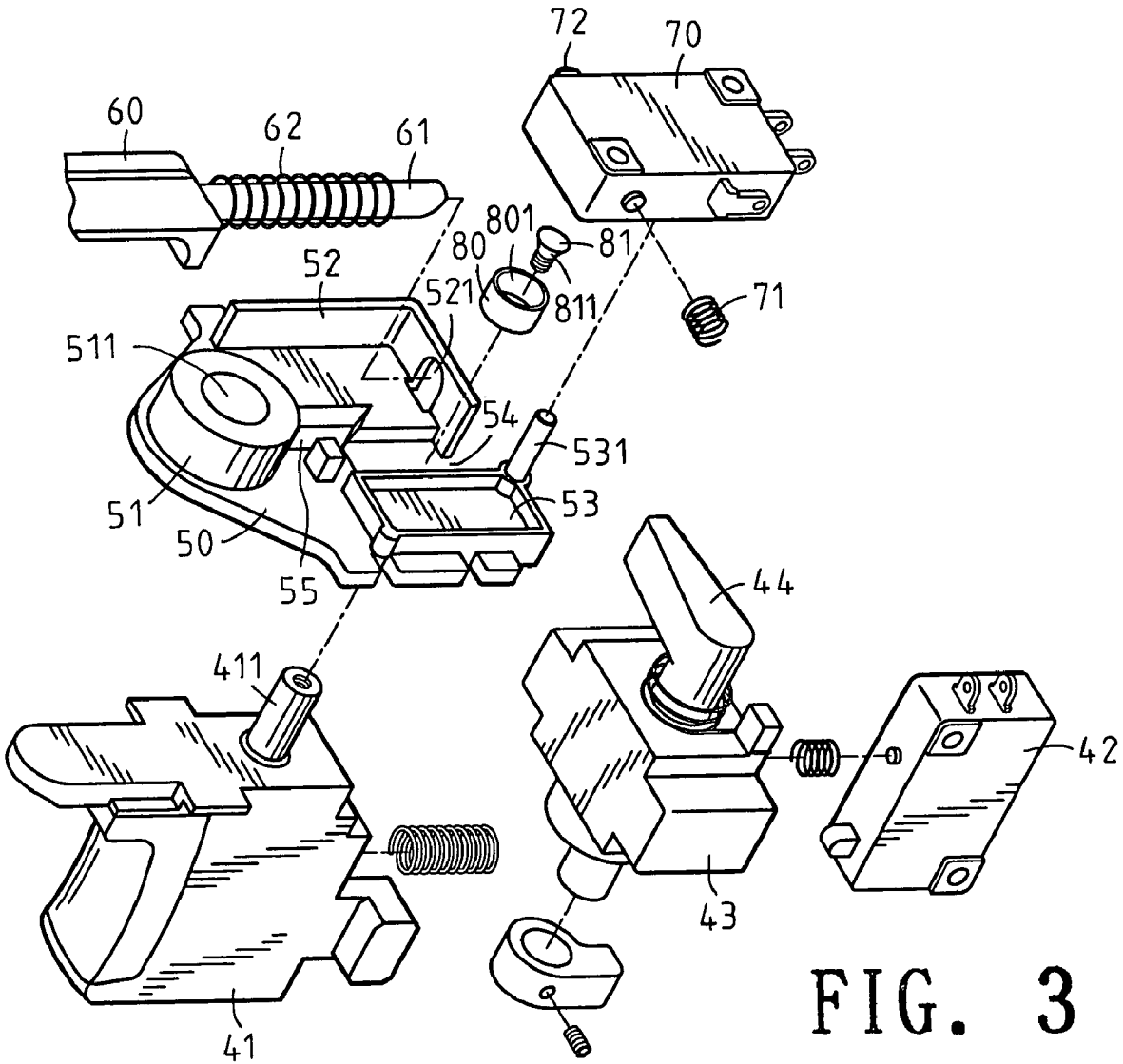
FIG. 3 is an exploded view to show the protection device of the nail gun of the present invention.

Referring to FIGS. 1 to 3, the DC-powered nail gun of the present invention comprises a body having a barrel and a handle 4 is connected to the barrel. A nose 21 is connected to a front end of the barrel and a magazine 31 is connected to the nose 21. The magazine 31 has nails received therein and the nails are sent into the nose 21 to be ejected. A shooting unit 2 is received in the barrel and has a frame 22 and a push member 23 is movably along side rails 221 on the frame 22. A rod 25 is connected to the frame 22 and a first spring 24 is mounted to the rod 25. The push member 23 can be pushed to compress the first spring 24 which stores force to eject the nail in the nose when the first spring 24 is released. An end cap 26 is connected to a rear end of the barrel.

A driving unit 3 includes a driving mechanism which is electrically connected to a battery pack and the driving mechanism has a disk 34 which has a protrusion 35 extending from a top thereof so as to push the push member 23 to compress the first spring 24. The driving mechanism includes a motor 32 and a gear box 33 which is connected with the disk 34.

A trigger 41 is connected to the handle 4 and a slide member 43 is connected to the trigger 41. A first switch 42 is connected to the slide member 43, and a swing bar 44 rotatably extends through the slide member 43.

A protection device is received in the shooting unit 2 and has a switch frame 50 located on a top of the trigger 41. The switch frame 50 includes a tube 51 through which a passage 511 is defined. An L-shaped wall 52 extends from the switch frame 50 and a rectangular recess 53 is defined beside the L-shaped wall 52. A groove 54 is defined through the switch frame 50 and located between the L-shaped wall 52 and the rectangular recess 53. A connection member "A" extends through the passage 511 so as to connect the trigger 41 to the switch frame 50. The connection member "A" is hooked with a hook member 27 which is pivotably connected to the frame 22. The nose 21 has to be pushed against an object to be nailed to disengage the hook member 27 from the connection member "A" such that the trigger 41 can be effectively pulled to eject the nails. The short side of the L-shaped wall 52 has a hole 521 so that a push rod 61 extends through the hole 521. The push rod 61 is connected to a base 60 located beside the second switch 70 and a third spring 62 is mounted on the push rod 61.

A connection rod 411 extends from the trigger 41 and extends through the groove 54 of the switch frame 50. A collar 80 is mounted to an outer periphery of the connection rod 411 and a bolt 81 is threadedly connected to the connection rod 411. An inner diameter of the collar 80 is larger than an outer diameter of the connection rod 411. The collar 80 includes a tapered inner periphery 801 and the bolt 81 has a tapered outer periphery 811 which has the same slope as the tapered inner periphery 801, so that the collar 80 is movably supported by the switch frame 50. A positioning rod 531 extends from the switch frame 50 and is pivotably connected to a first corner of a second switch 70. A second spring 71 biases a second corner of the second switch 70. The first and second corners located on two opposite sides and on two ends of the diagonal line of the rectangular second switch 70 so that the second switch 70 is pivoted about the positioning rod 531 by the second spring 71.

The push rod 61 and the base 60 are pushed by the swing bar 44 to shot off the first switch 42. The switch frame 50 has a guide rod 55 which includes an inclined surface which pushes the collar 80 to pivot the second switch 70 so that an activation button 72 on the second switch 70 is moved away from the push member 23 when the trigger 41 is not pulled.

Figure 5:
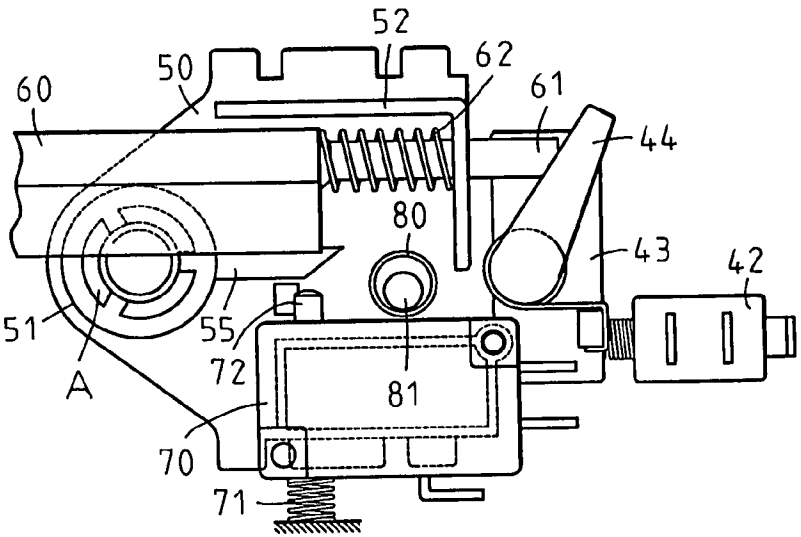
FIG. 5 shows the protection device of the present invention when the trigger is pulled.
Figure 4:
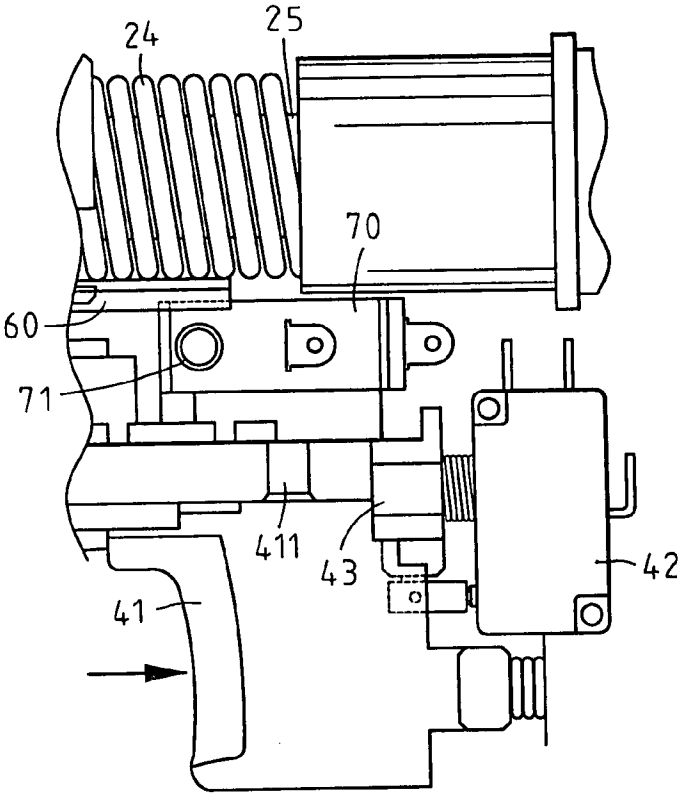
FIG. 4 shows that the trigger is pulled.

As shown in FIGS. 4 and 5, when the trigger 41 is pulled, the first switch 42 is activated and the collar 80 is moved away from the inclined surface of the guide rod 55. The second switch 70 is pushed by the second spring 71 and in alignment with the rectangular recess 53. In the meanwhile, the first switch 42 is activated to rotate the disk 34 and the protrusion 35 moves the push member 23 to compress the first spring 24 till the push member 23 touches the activation button 72 on a side of the second switch 70. The disk 34 continues to rotate and the base 60 is pushed by the push member 23 and the push rod 61 is moved to touch the swing bar 44 to shut off the first switch 42. When the disk 34 rotates and moves over the push member 23 which then moves by the force of the first spring 24 at a high speed to eject a nail.

Figure 7:
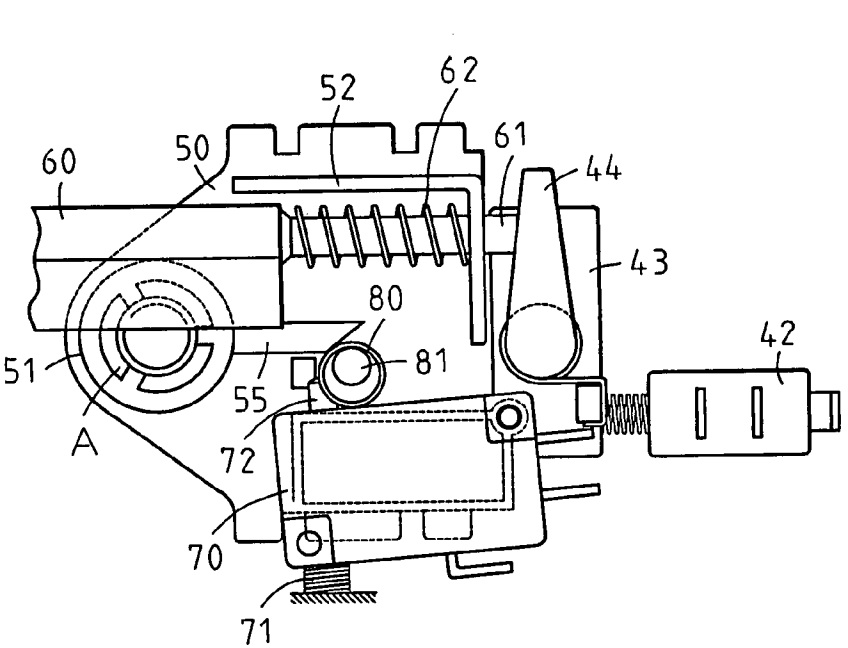
FIG. 7 shows the protection device when the trigger is released.
Figure 6:
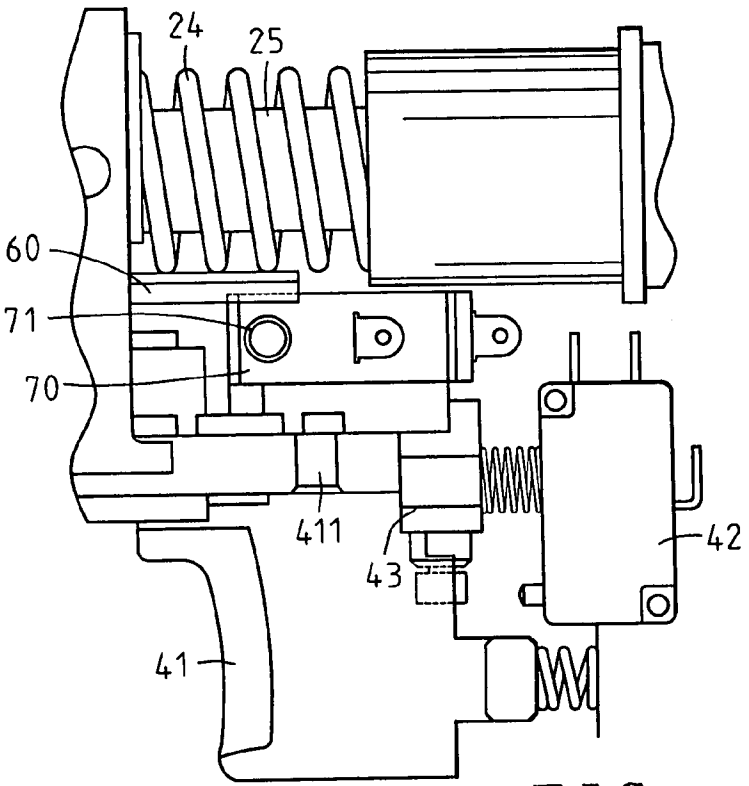
FIG. 6 shows that the trigger is released.

Referring to FIGS. 6 and 7, after shooting, the trigger 41 is released and the collar 80 is moved back together with the movement of the connection rod 411 and pushed by the inclined surface of the guide rod 55. The second switch 70 is then pivoted and the activation button 72 is then away from the push member 23. By this way, even if a new battery pack is installed to the nail gun, the nail in the nose 21 does not shoot.

While we have shown and described the embodiment in accordance with the present invention, it should be clear to those skilled in the art that further embodiments may be made without departing from the scope of the present invention.

What is claimed is:

1. A DC-powered nail gun comprising:

a body having a barrel and a handle connected to the barrel, a nose connected to a front end of the barrel and a magazine connected to the nose, a shooting unit received in the barrel and having a frame and a push member movably along side rails on the frame, a rod connected to the frame and a first spring mounted to the rod, an end cap connected to a rear end of the barrel;

a driving unit including a driving mechanism which is adapted to be electrically connected to a battery pack, the driving mechanism having a disk and a protrusion extending from a top of the disk, the protrusion pushing the push member to compress the first spring;

a trigger connected to the handle and a slide member connected to the trigger, a first switch connected to the slide member, a swing bar rotatably extending through the slide member;

a protection device received in the shooting unit and having a switch frame located on a top of the trigger, a connection rod extending from the trigger and extending through the switch frame, a collar mounted to an outer periphery of the connection rod and a bolt threadedly connected to the connection rod, an inner diameter of the collar being larger than an outer diameter of the connection rod so that the collar is movably supported by the switch frame, a positioning rod extending from the switch frame and pivotably connected to a first corner of a second switch, a second spring biasing a second corner of the second switch, the first and second corners located on two opposite sides so that the second switch is pivoted about the positioning rod by the second spring, a base located beside the second switch and having a push rod connected thereto, a third spring mounted on the push rod, the push rod and the base being pushed by the swing bar to shut off the first switch, the switch frame having a guide rod which includes an inclined surface which pushes the collar to pivot the second switch so that an activation button on the second switch is moved away from the push member when the trigger is not pulled.

2. The nail gun as claimed in claim 1, wherein the collar includes a tapered inner periphery and the bolt has a tapered outer periphery which has the same slope as the tapered inner periphery.

* * * * *